United States Patent [19]

Bühler

[11] 4,209,055

[45] Jun. 24, 1980

[54] PROCEEDING AND APPARATUS FOR COOLING, DRYING AND SEPARATING CASTINGS AND FOUNDRY SAND IN A COOLING DEVICE

[76] Inventor: Eugen Bühler, Schleifweg 3, 8871 Burtenbach, Fed. Rep. of Germany

[21] Appl. No.: 961,900

[22] Filed: Nov. 20, 1978

[30] Foreign Application Priority Data

Nov. 18, 1977 [DE] Fed. Rep. of Germany ..... 2751500
Nov. 7, 1978 [DE] Fed. Rep. of Germany ..... 2848195

[51] Int. Cl.[2] ..... B22D 29/00
[52] U.S. Cl. ..... 164/4; 164/131; 164/401; 209/11
[58] Field of Search ..... 164/131, 132, 269, 270, 164/344, 404, 412, 4; 209/291, 293, 296, 297, 11

[56] References Cited

U.S. PATENT DOCUMENTS

| | | | |
|---|---|---|---|
| 328,268 | 10/1885 | Willford | 209/296 |
| 1,053,410 | 2/1913 | Liden | 209/291 |
| 1,430,664 | 10/1922 | Madson | 209/291 |
| 1,617,919 | 2/1927 | Madsen | 209/291 |

FOREIGN PATENT DOCUMENTS

| | | | |
|---|---|---|---|
| 2726931 | 12/1977 | Fed. Rep. of Germany | 164/269 |
| 2238905 | 3/1975 | France | 164/270 |
| 197806 | 6/1978 | Netherlands | 164/404 |

*Primary Examiner*—Robert D. Baldwin
*Assistant Examiner*—K. Y. Lin
*Attorney, Agent, or Firm*—Edwin E. Greigg

[57] ABSTRACT

There is proposed herein a method and apparatus for cooling, drying and separating casting pieces and molding sand and wherein the apparatus includes an opening that extends lengthwise therethrough, the cooling operation being conducted by inducting air in a rotary drum that is contiguous to a first rotary chamber that is in juxtaposition relative to a stationary chamber. The sand is caused to pass through perforated areas within the apparatus while the casting pieces continue through the axial opening in the stationary chamber. A perforated divider wall disposed between the first rotary chamber and the stationary chamber permits passage of sand to a discharge valve and vents air to atmosphere. In a further embodiment of the invention a polygonal sieve is disposed between the rotary chamber and the stationary chamber, said sieve being a truncated pyramid and provided with guide foils.

18 Claims, 4 Drawing Figures

PROCEEDING AND APPARATUS FOR COOLING, DRYING AND SEPARATING CASTINGS AND FOUNDRY SAND IN A COOLING DEVICE

BACKGROUND OF THE INVENTION

This invention relates to structures of the type wherein there are cooling drums in which hot casting pieces and molding sand are introduced at one side, travel lengthwise of and through the cooling drum as it is rotated, and finally exit again at the other side, having immediately previously been separated by sifting. In such drums the cooling of the sand and the castings is effected by evaporating water, which is drawn out of the sand or is supplementarily added. (See, for example, the German laid-open application 26 07 265.).

One problem with such cooling drums is that the sand, especially in strongly alternating casting procedures, can never with complete assurance be brought below a desired final temperature (as an example, below 30° C.) when leaving the cooling drum, and that the sand is usually not yet fine enough at this time or that it still contains lumps.

However, for the further processing of the sand, it is known that just such fineness and a predeterminable low temperature are desirable.

OBJECT AND SUMMARY OF THE INVENTION

A desired condition of the sand such as is described above is now attained by means of the method recited in the claims which form a part thereof. In this method, the molding sand is collected from the perforated portion of the cooling drum into a rotating chamber, which encloses the cooling drum, then is aspirated via a further perforated intermediate wall into a second chamber by means of an air current flowing from the cooling drum, is separated in the second chamber from the air current by the force of gravity, and is finally carried out at the lowest point of this second chamber. Prior to this, the sand is dried to the extent possible in the forward half of the cooling drum, in order to bring about the breakdown at this early stage of lumps which have been baked hard during casting. By means of the exhaust air, the undesired dust component of the molding sand, which comprises burned-out binder elements, splintered superfine grains, etc., is carried out of the second chamber and delivered to a dust separator.

The decisive action is now produced by the fact that a sand-air mixture is aspirated out of the first chamber through the perforated intermediate wall and thereby, as a result of the intensive contact with a great deal of air, a critical amount of water is drawn out of the sand. By this means, it is possible to cool the sand, even to below room temperature. The prerequisite is that the sand falling through the holes in the perforated portion of the cooling drum into the first chamber still has a certain remnant dampness, the heat of evaporation of which effects the cooling action. Under greatly changing operating conditions, it is therefore efficient to monitor the temperature of the sand and possibly also its dampness in the first chamber, and, as needed, to inject regulated quantities of water into the cooling drum just before the perforated portion, in order to re-dampen the pre-dried sand. The path of the air, and therefore the cooling as well crosses the perforated portion and travels through the sand rotating in the first chamber. The air current is regulatable in its strength and thus carries with it only the light, very finely pulverized and relatively dry particles of sand, leaving the coarser sand lumps behind in the rotating first chamber.

These coarser lumps of sand may be reduced in size and pulverized in the first chamber with the aid of grinding bodies. However, when they primarily comprise core remnants, it can be advantageous to separate the sand lumps from the molding sand, which is to be reprocessed, as early as possible and to collect them in a special chamber, because it is undesirable to have various core binder types in the prepared molding sand.

The object of the invention is thus optimally attained in positively cooling the molding sand to below a predetermined final temperature—which may even be below room temperature—and simultaneously making it available for further processing with a very great degree of fineness and grain uniformity, while the sand is also simultaneously freed of dust.

The invention will be better understood as well as further objects and advantages thereof become more apparent from the ensuing detailed description of preferred embodiments taken in conjunction with the drawings.

DESCRIPTION OF THE PREFERRED EMBODIMENTS

Figure 1:
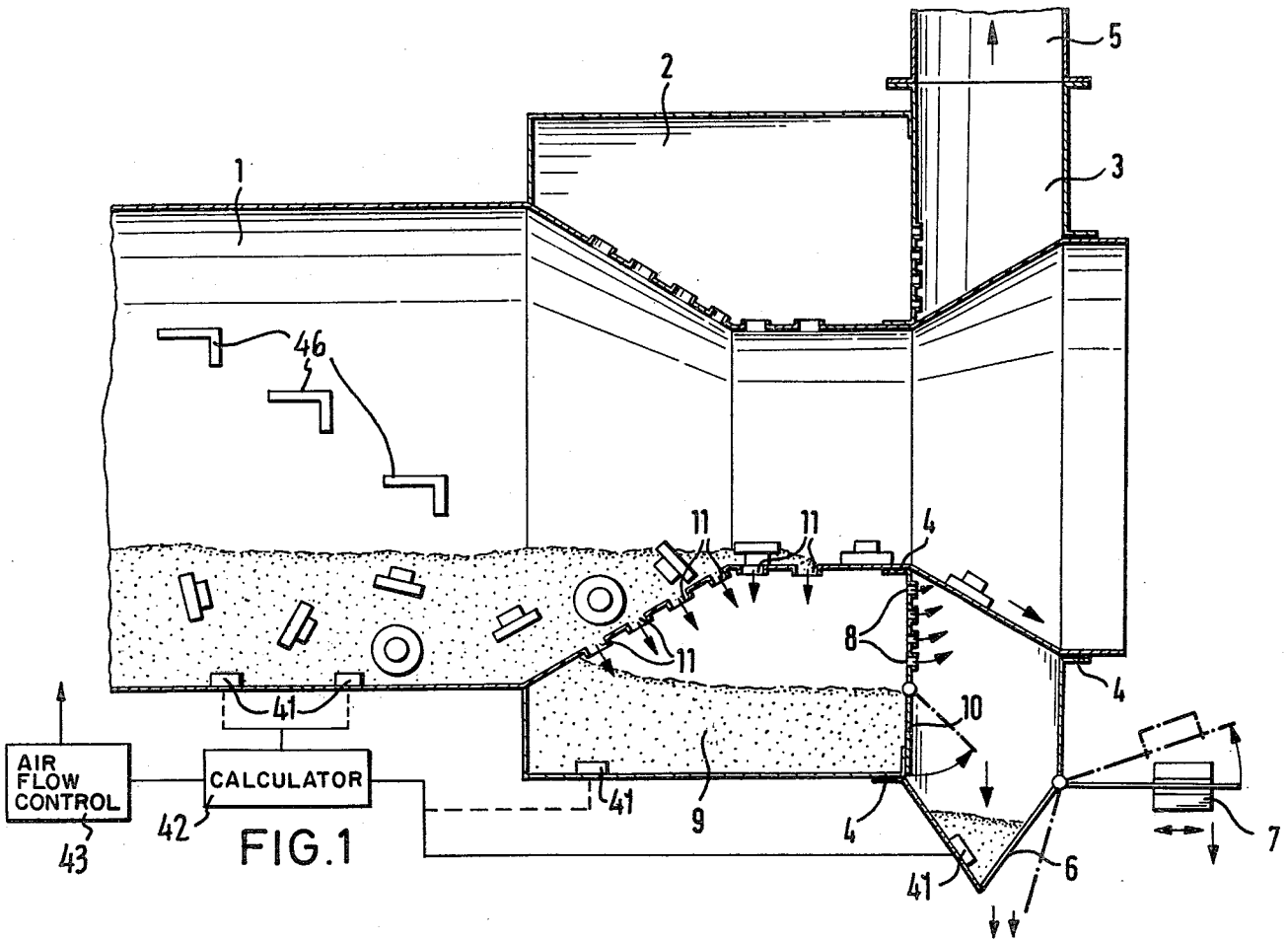
FIG. 1 shows a schematic side view of the principle of one embodiment of the invention designed to carry out the method of claims 1–8.

Turning now to FIG. 1, and considering the drawing from left to right, a rotatable cooling drum 1 is surrounded on its terminal portion, which is provided with flow-through openings 11 for molding sand, by a first chamber 2 which may be rotated independently of the cooling drum 1 by suitable means (not shown), if desired, and a second terminal chamber 3. The terminal chamber 3 is a stationary and is sealed off by sealing elements 4 from the rotatable cooling drum 1 and the wall portions of the second chamber 2 which rotate together with the cooling drum 1. Coupler strips 46 are provided on the inner wall of the cooling drum 1 preferably in the form of round iron bars bent at right angles and arranged helically as shown in FIG. 1. An air outlet connection 5 is provided at the upper portion of the terminal chamber 3. The lower portion of the terminal chamber 3 is embodied as a collector container for dried and cooled sand, which may be dried to an approximate water content of 1%, and is closed off by a valve 6. The force of a spring or a counterweight 7 acts to press the valve 6 upwardly, the arrangement being such that the resultant force is in a particular ratio to that of the downwardly exerted weight of the sand which overcomes the force and is thus permitted to flow out. Below the valve 6 there is a transport means, such as a conveyor belt, which, however, is not illustrated.

The wall between the first chamber 2 and the terminal chamber 3 is perforated at least in part and provided with flow-through openings 8 for passage of the sand 9 which is tumbling in the rotating first chamber 2. A door 10 (FIG. 1) is further provided, in order to empty the first chamber 2 completely if needed. Preferably, as indicated in FIG. 1, the sand temperature or dampness or both may be measured at several points in the cooling drum 1, the first chamber 2 and the second chamber 3 by suitable transducers 41. The measurement values from transducers 41 are fed to a calculator 42 and a closed-loop feedback device or air flow control 43 to provide an output signal which is used to control the cooling and drying procedures.

Figure 2:
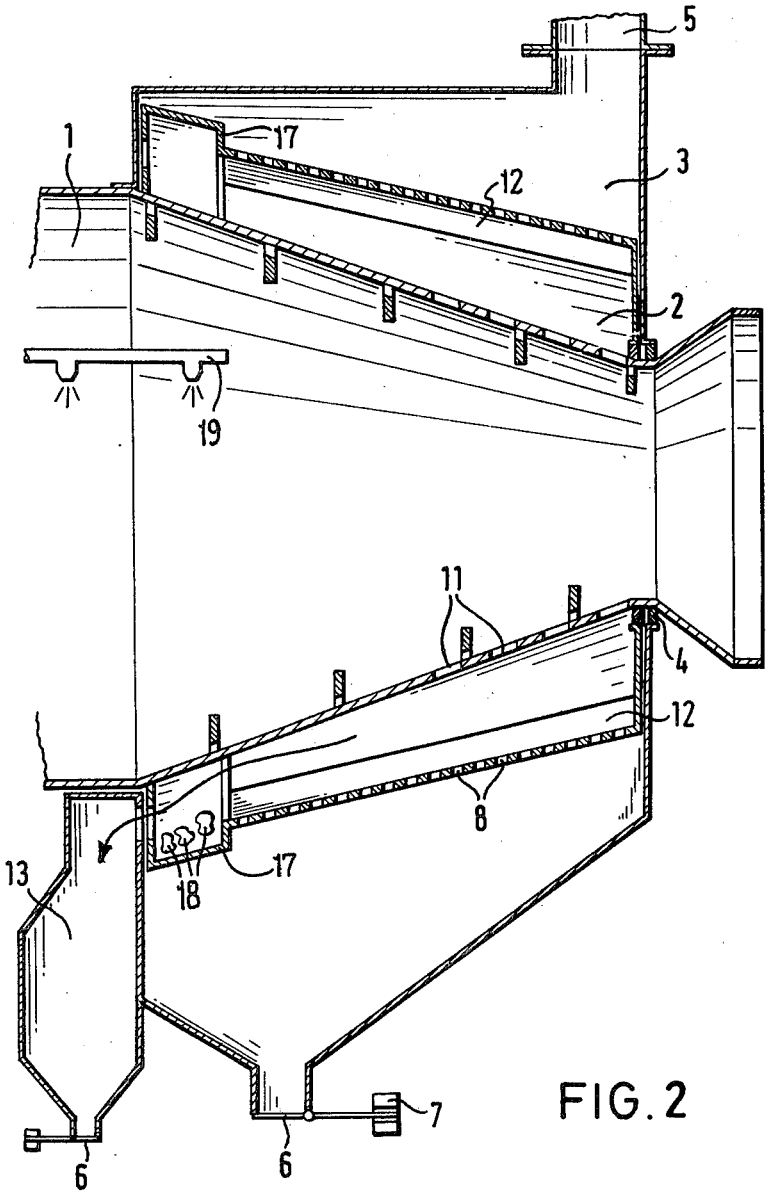
FIG. 2 is a detailed view of a preferred embodiment of the cooling drum in accordance with the invention in a partially cutaway side view.
Figure 3:
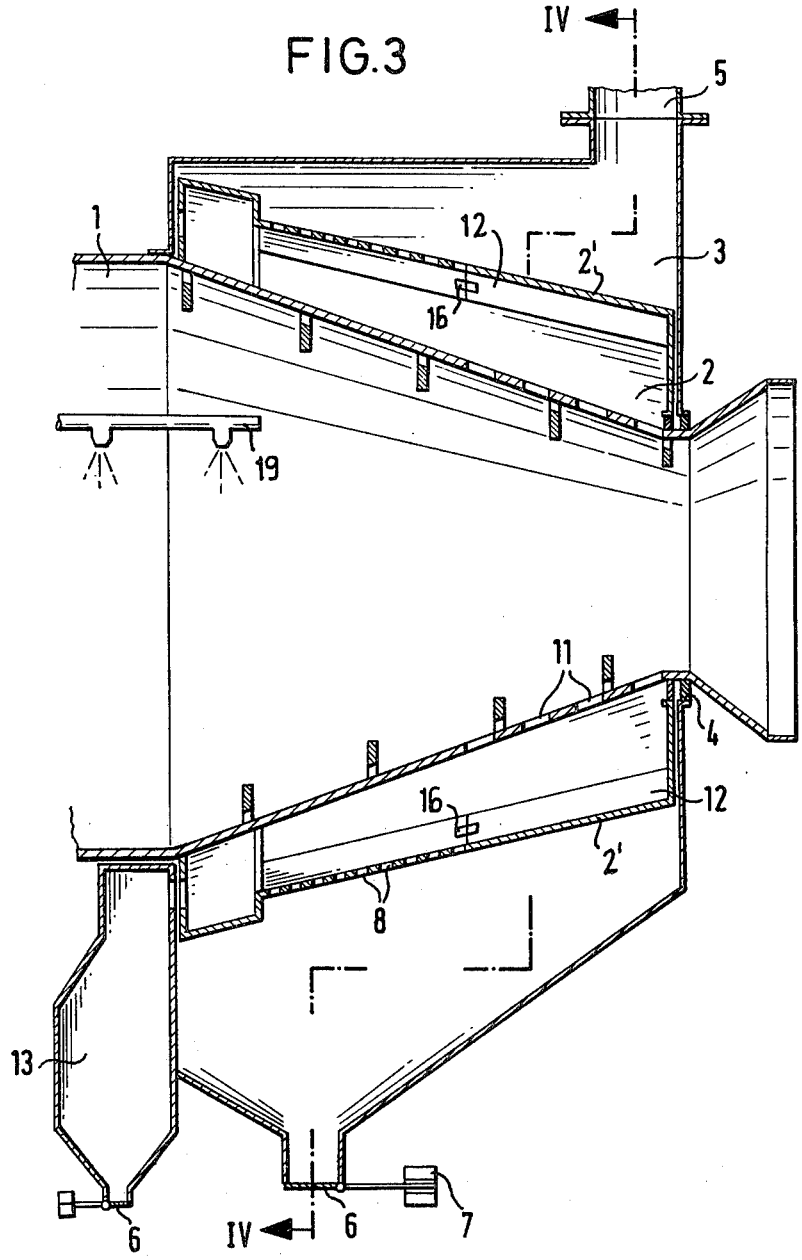
FIG. 3 is another detailed view of another preferred embodiment of the cooling drum in accordance with the invention in a partially cutaway side view.
Figure 4:
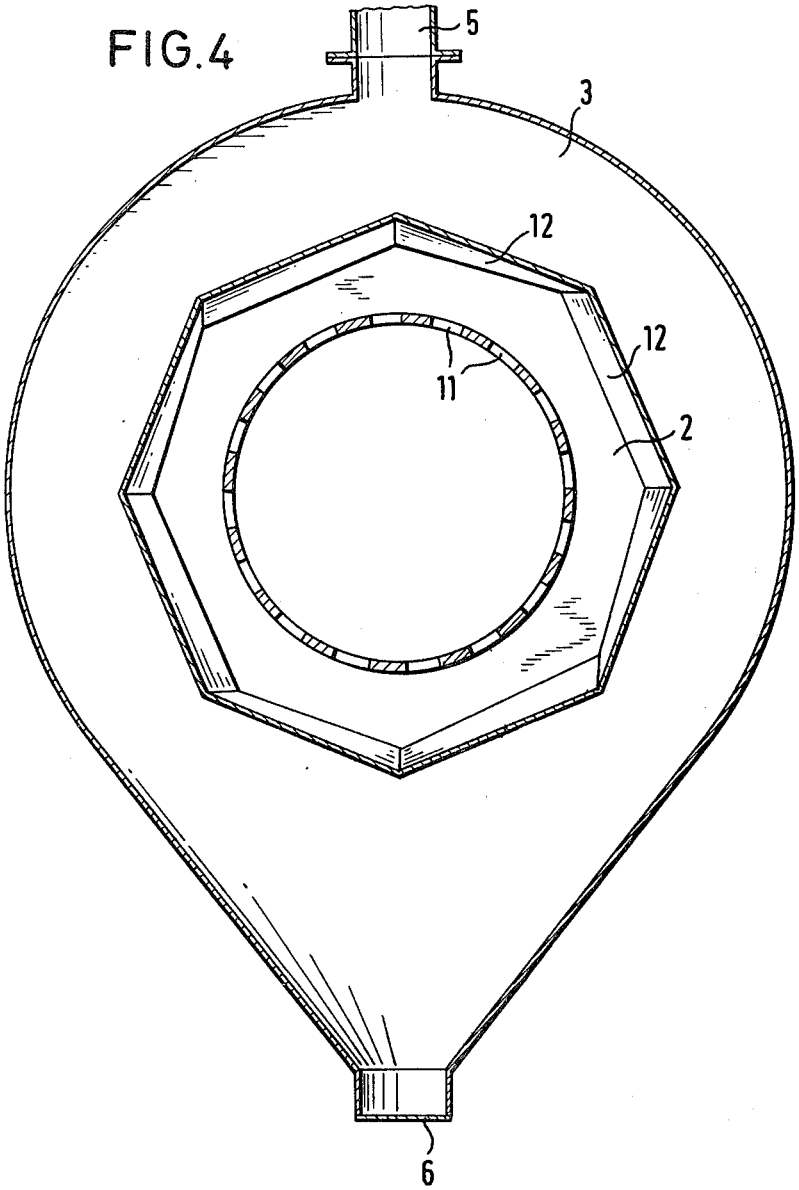
FIG. 4 is a sectional view along the line IV—IV of FIG. 3.

In the cooling drums shown in FIGS. 2–4, which preferably include a water sprayer 19, the wall between the first chamber 2 and the second chamber 3 comprises a polygonal sieve, which is embodied in the form of a truncated pyramid and whose interior wall is provided with guide foils or fins 12. The guide foils or fins 12, as is shown in FIG. 4, are arranged alternatively radially and chord-like on the interior wall of the frusto-pyramidal jacket.

A particularly effective cooling action is obtained when the frusto-pyramidal jacket has a section of unperforated sheet metal 2' surrounding the region of the cooling drum 1 which is provided with flow-through openings 11 as shown in FIG. 3. Attached to this unperforated section is a sieve portion which surrounds the unperforated wall area of the cooling drum, while the guide foils or fins 12 are connected with each other at the attachment point of the jacket sections by means of sheet metal tabs 16 and thus form sand pockets all around the inside of the jacket.

The lower end of the polygonal sieve, at the base, is efficiently extended at 17 (FIG. 2) in a somewhat offset manner. The said lumps and metallic residues which do not fit through the narrow flow-through openings 8 of the sieve roll into this extension 17. They are then carried continuously out into a stationary collector chamber 13, which is closed off at the lower end by means of a valve 6, which has already been described, and sealed off from the rotating wall portions.

It is also possible to introduce grinding elements such as field stones 18 into the offset extension 17 of the first chamber 2, in order to collect the sand of the core residues, which is already pulverized, in the subsequent collector chamber 13 separately from the molding sand in the second chamber 3. Such relatively large field stones, which are to some extent carried along in the rotating drum, repeatedly fall onto the material which is to be comminuted and break the material up.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. A method for cooling, drying and separating casting pieces and molding sand in a rotating cooling drum, comprising the steps of:
   - providing a rotatable cooling drum having a perforated portion surrounded by a continuous first chamber;
   - introducing casting pieces and molding sand into one end of said perforated rotatable cooling drum;
   - rotating said cooling drum;
   - advancing the sand and said casting pieces lengthwise through said drum into said perforated portion while simultaneously inducing and regulating air through said cooling drum and said first chamber;
   - separating the traveling sand from said casting pieces in proximity to said first chamber; and
   - transporting said sand to a stationary chamber.

2. A method in accordance with claim 1, the further steps wherein a sand-air mixture is forced through a perforated wall disposed between said first chamber and said stationary chamber.

3. A method in accordance with claim 1, the further step wherein said first chamber is driven together with said cooling drum.

4. A method in accordance with claim 1, including the further step of driving said first chamber independently of the rotary speed and rotary direction of said cooling drum.

5. A method in accordance with claim 1, the further step wherein said first chamber is filled with grinding elements in order to break down sand lumps.

6. A method in accordance with claim 1, further wherein said cooling drum has front and rear portions, water is introduced into said rear portion and drying takes place in said forward portion of said cooling drum.

7. A method in accordance with claim 6, the further step wherein said sand is dried to an approximate water content of 1%.

8. A method in accordance with claim 6, including the steps of measuring at least one of sand temperature and sand dampness at least at one of several points in the cooling drum, in the first and in the second chamber and feeding the measurement values to a calculator and closed-loop feedback device to provide an output signal, and controlling the cooling and drying procedure with said output signal.

9. An apparatus for cooling, drying, and separating casting pieces and molding sand, comprising:
   - a cooling drum open at both ends which is rotatable about its longitudinal axis and having a terminal end wall;
   - water injection apparatus in said cooling drum;
   - a perforated area in the cooling drum located forward of the terminal opening;
   - coupler strips arranged on an interior wall of said drum, and further wherein:
   - said cooling drum has a terminal portion partially surrounded by a collector chamber which is subdivided by a partially perforated intermediate wall into a first chamber entirely surrounding the perforated wall area of the cooling drum and a second chamber sealed off from said cooling drum, said second chamber having an air intake attachment on an upper end and a closable sand discharge area opening on a lower end.

10. An apparatus in accordance with claim 9, further wherein said perforated intermediate wall disposed between said first chamber and said second chamber is embodied as a polygonal sieve.

11. An apparatus in accordance with claim 10, further wherein said polygonal sieve comprises a frusto-pyramidal jacket having an interior wall provided with guide foils.

12. An apparatus in accordance with claim 11, further wherein said guide foils are disposed on the interior wall of the frusto-pyramidal jacket alternatively radially and chord-like.

13. An apparatus in accordance with claim 12, further wherein said polygonal frusto-pyramidal jacket has a section of unperforated sheet metal surrounding said perforated wall area of the cooling drum, a sieve section attached to said unperforated sheet metal, and the connection point between said two sections of the guide foils are connected with each other by sheet metal tabs.

14. An apparatus in accordance with claim 10, further wherein said frusto-pyramidal polygonal sieve is provided with a further collector chamber.

15. An apparatus in accordance with claim 9, further wherein said discharge end of said second chamber includes a valve means.

16. An apparatus in accordance with claim 15, further wherein said valve means is controllable by a counterweight force.

17. An apparatus in accordance with claim 14, further wherein said collector chamber includes a valve means.

18. An apparatus in accordance with claim 9, further wherein said coupler strips are arranged helically and comprise perforated flat iron bars, T-vanes, or round iron bars bent at right angles.

* * * * *